US006796708B2

(12) United States Patent
Kawamata et al.

(10) Patent No.: US 6,796,708 B2
(45) Date of Patent: Sep. 28, 2004

(54) WRIST MOUNTING-TYPE PORTABLE ELECTRONIC APPARATUS HAVING BANGLE-TYPE STRAP

(75) Inventors: Hiroshi Kawamata, Chiba (JP); Takenori Matsunaga, Chiba (JP); Hiroshi Igarashi, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 10/378,721

(22) Filed: Mar. 4, 2003

(65) Prior Publication Data

US 2003/0174589 A1 Sep. 18, 2003

(30) Foreign Application Priority Data

Mar. 15, 2002 (JP) ..... 2002-072271

(51) Int. Cl.[7] ..... G04B 37/00
(52) U.S. Cl. ..... 368/282; 368/276; 368/289
(58) Field of Search ..... 368/281–282, 368/276–277, 286–291, 309–310, 313

(56) References Cited

U.S. PATENT DOCUMENTS 3,822,546 A * 7/1974 Nozawa ..... 368/291
3,849,981 A * 11/1974 Tarusawa et al. ..... 368/291
3,858,388 A * 1/1975 Fujimori et al. ..... 368/291
4,110,970 A * 9/1978 Funazawa et al. ..... 368/291
4,151,707 A * 5/1979 Cobelli ..... 368/190
4,244,044 A * 1/1981 Olsson ..... 368/291
5,333,123 A * 7/1994 Plancon et al. ..... 368/276

FOREIGN PATENT DOCUMENTS

JP 4331397 * 11/1992 ..... 368/289

* cited by examiner

*Primary Examiner*—David Martin
*Assistant Examiner*—Michael L. Lindinger
(74) *Attorney, Agent, or Firm*—Adams & Wilks

(57) ABSTRACT

A wrist mountable electronic apparatus has a strap member having a pair of strap portions. Each of the strap portions has an end disposed in spaced-apart relation to the other so that inner peripheral surfaces of the ends of the strap portions form a hole having a first open end and a second open end opposite the first open end. Each of the inner peripheral surfaces of the strap portions has a stepped portion. A portable electronic apparatus is disposed in the hole of the strap member. A glass member is supported on the stepped portion of each of the strap portions for closing the first open end of the hole. A connecting structure free of adhesive connects the glass member to each of the strap portions. A waterproof member is disposed directly between only the glass member and the strap member for providing a water-tight seal therebetween. A rear cover covers the second open end of the hole.

20 Claims, 4 Drawing Sheets

WRIST MOUNTING-TYPE PORTABLE ELECTRONIC APPARATUS HAVING BANGLE-TYPE STRAP

BACKGROUND OF THE INVENTION

1. Field of the Invention

The present invention relates to a wrist mounting type portable electronic apparatus having a case integrated type bangle type strap and, more particularly, to a structure for fixing a glass member which closes an upper side opening of a case containing an apparatus main body to a case integrated type bangle type strap.

2. Description of the Prior Art

A wrist mounting type portable apparatus of a wrist watch, a wrist mounting type altimeter, a wrist mounting type heart beat meter or the like is constituted by a portable apparatus and a wrist mounting piece. The portable apparatus is constituted by an apparatus main body and a case in a circular shape, a square shape or the like containing the apparatus main body at inside thereof. The apparatus main body is constituted by various mechanical parts and electronic parts to realize an inherent function of a wrist watch, an altimeter, a heat beat meter or the like. The portable apparatus is constituted by the case in a circular shape, a square shape or the like for containing and fixing the apparatus main body. The case is a case not only for simply containing and fixing the apparatus main body of the portable apparatus but realizing also properties of water proof property, pressure resistance property, impact resistance property and the like of the apparatus. Therefore, both of the apparatus main body and the case are indispensable for constituting the wrist mounting type portable apparatus.

The wrist mounting piece is generally a member separate from the case. That is, a general wrist mounting piece is a strap made of skin, made of metal, made of plastic or made of cloth, and many of these are constituted by a pair of left and right strap pieces. Left and right end portions of the case are formed with strap attaching portions. Further, the strap is attached to the case by fixedly attaching respective one-side ends of the pair of strap pieces to the left and right strap attaching portions of the case. By attaching the strap to the case, the wrist mounting type portable apparatus is completed. By this construction, according to the strap used in the wrist mounting type portable apparatus, the pair of left and right strap pieces are separate from each other.

However, there is a strap used in a wrist mounting type portable apparatus which is referred to as a bangle type strap integrated with a pair of left and right strap pieces made of hard plastic or made of metal. A bangle is an ornamental bracelet and a bangle in a shape of a complete ring and a bangle in a shape of an incomplete ring turned around to about 300 degrees are representative. The bangle type strap used in a wrist mounting type portable apparatus is a strap in a shape of an incomplete ring and turned around to about 300 degrees as in the latter case. Although the wrist mounting type portable apparatus having such a bangle type strap achieves an advantage that attachment and detachment to and from the wrist is facilitated in comparison with a wrist mounting type portable apparatus having a strap in which a pair of left and right strap pieces are separate from each other, several problems are posed in view of the structure.

There are two kinds of wrist mounting type portable apparatus having a conventional bangle type strap. The first is a wrist mounting type portable apparatus having a case integrated type bangle type strap in which a strap and a case are integrated. The second is a wrist mounting type portable apparatus having a case separated type bangle type strap in which a strap and a case are separated.

The wrist mounting type portable apparatus having the case separated type bangle type strap is constituted by a portable apparatus and a case separated type bangle type strap. The portable apparatus is constituted by an apparatus main body and a case in a circular shape, a square shape or the like for containing and fixing the apparatus main body. The case is a case not only for simply containing and fixing the apparatus main body of the portable apparatus but realizing properties of waterproof property, pressure resistance property, impact resistance property and the like of the apparatus.

The case separated type bangle type strap is formed with strap piece portions on a left side and on a right side thereof and formed with an attaching hole for attaching the case at a central portion thereof. The case of the portable apparatus is mounted to the attaching hole of the case separated type bangle type strap and fixed thereto by a fixing part of a setscrew or the like. Owning to the structure, the wrist mounting type portable apparatus having the case separated type bangle type strap does not effect any influence on the performance of containing the case, the waterproof property, the impact resistance property and the like. However, according to the wrist mounting type portable apparatus having the case separated type bangle type strap, a fixing part of a setscrew or the like needs to use for fixing the case and therefore, there poses a problem in view of the structure that the case size is enlarged by that amount. Therefore, the wrist mounting type portable apparatus having the case separated type bangle type strap is not applicable to a wrist watch of a female size.

In contrast thereto, a wrist mounting type portable apparatus having a case integrated type bangle type strap is constituted by a bangle type strap made of metal or hard plastic formed with a case hole at a center portion thereof for coupling a pair of strap pieces substantially in a semicircular shape extended in left and right directions, an apparatus main body contained in the case hole and a glass member closing an upper side opening of the case hole of the bangle type strap.

That is, as shown by FIG. 4, the wrist mounting type portable apparatus having the case integrated type bangle type strap is constituted by a portable apparatus 10 and a case integrated type bangle type strap 20. The case integrated type bangle type strap 20 is a strap made of metal or made of hard plastic formed with a case hole 22 for containing an apparatus main body at a central portion 21 having a thick wall and a wide width and formed with a left side strap piece 23 and a right side strap piece 24 respectively on left and right sides thereof. A stepped portion is formed at an inner peripheral face at a vicinity of an upper side opening of the case hole 22. After containing the portable apparatus 10 at a predetermined location of the case hole 22, a glass member 25 is fitted to the upper side opening of the case hole 22 such that a lower face thereof is seated on the stepped portion and fixed thereto by welding or an adhering agent. In this way, by welding or adhering the glass member 25 and the strap 20, the waterproof property of the upper side. opening of the case hole 22 is guaranteed.

On the other hand, a lower side opening of the case hole 22 is closed by a male screw 26 in a shape of a circular disk after containing a battery 10*a* at a predetermined location of the case hole 22. A rubber packing is arranged between a head portion of the male screw 26 in the circular disk shape and a peripheral edge portion of the lower side opening of the case hole 22 and the water proof property of the lower side opening of the case hole 22 is guaranteed by screwing to fasten the male screw 26 in the circular disk shape to a female screw portion formed at an inner peripheral face of the lower side opening of the case hole 22.

According to the conventional wrist mounting type portable apparatus, in the case of the wrist mounting type portable apparatus having the case integrated type bangle type strap, the strap needs to open to mount to the wrist. That is, it is necessary to open the strap by pulling an end portion 23*a* of the left side strap piece 23 and an end portion 24*a* of the right side strap piece 24 respectively to outer peripheral sides. Then, the case hole 22 of the case integrated type bangle type strap 20 is applied with stresses produced by pulling to open the strap. The stresses applied by pulling to open the strap concentrate on left and right inner peripheral faces of the case hole 22 in a strap length direction. When the wrist mounting type portable apparatus is explained by a wrist watch, the stresses are concentrated on the inner peripheral faces of the case hole 22 in a 12 o'clock direction and a 6 o'clock direction. Therefore, the upper side opening of the case hole 22 may be deformed to peel off the fixing portion of the case hole 22 and the glass member 25. When the peel off is brought about, there poses a problem that waterproof cannot be guaranteed and the glass member 25 is detached from the case hole 22 in the worst case of the peel off.

In order to deal with the above-described problem, according to the conventional wrist mounting type portable apparatus having the case integrated type bangle type strap, there is adopted a structure in which a hinge mechanism for absorbing the stresses only by the strap 20 is put to a middle portion of the strap. That is, in the case integrated type bangle type strap 20 as shown by FIG. 4, the structure is a structure in which the hinge mechanisms are respectively put to a middle portion 23*b* of the left side strap piece 23 and a middle portion 24*b* of the right side strap piece 24. However, in the case of the hinge mechanism, there poses a problem that the skin or the hair around the wrist is caught in the hinge portion and in the case of a plastic strap, there is a concern of destructing the mechanism portion.

Hence, the invention provides a glass member fixing structure which prevents detachment of a glass member due to stress concentration by opening or closing a strap and which guarantees the waterproof property of the case in a wrist mounting type portable apparatus having a case integrated type bangle type strap.

SUMMARY OF THE INVENTION

In order to resolve the above-described problem, a wrist mounting type portable apparatus having a bangle type strap according to the invention is constituted by a bangle type strap made of plastic formed with a case hole at a central portion thereof for coupling a pair of strap pieces substantially in a semicircular shape extended in left and right directions, a portable apparatus contained in the case hole, a glass member seated on a stepped portion of the case hole of the bangle type strap for closing an upper side opening thereof and a case back for closing a lower side opening of the case hole and the glass member is fixed to the bangle type strap made of plastic by a fitting groove formed at one of a portion of an inner peripheral face of the case hole on a side upward from the stepped portion and a portion of a peripheral edge of the glass member and a fitting projection formed at other thereof. Further, as the bangle type strap made of plastic, a bangle type strap made of nylon species plastic is optimum.

When the fitting groove is provided at a portion of the inner peripheral face of the case hole, the fitting projection is provided at a portion of the peripheral edge of the glass member. Conversely, when the fitting groove is provided at a portion of the peripheral edge of the glass member, the fitting projection is provided at a portion of the inner peripheral face of the case hole.

Further, locations of providing the fitting groove or the fitting projection are provided at left and right inner peripheral faces of the case hole in a length direction of the strap, that is, portions at which stresses in opening and closing the strap are concentrated.

Further, in addition to a structure of biting to fix glass, a waterproofing rubber packing is arranged between a lower face of the glass member and the stepped portion of the inner peripheral face of the case hole to thereby promote waterproofing function.

Further, the wrist mounting type portable apparatus having the bangle type strap according to the invention includes a reinforcing plate comprising a material harder than the bangle type strap, and arranged between the portable apparatus and the inner peripheral face of the case hole for protecting the portable apparatus of the bangle type strap and restraining movement of the bangle type strap.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

Figure 1:
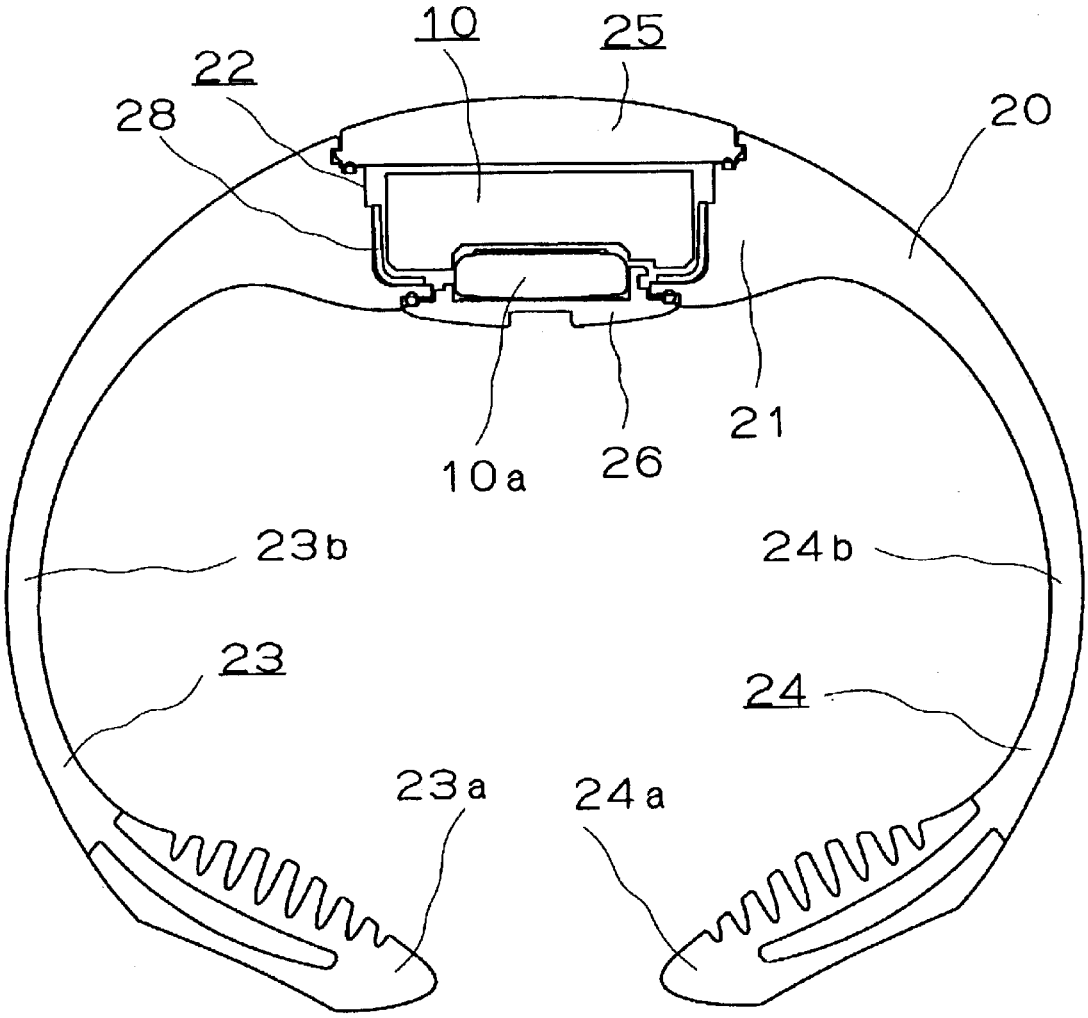
FIG. 1 is a sectional view cut in a strap length direction of a wrist mounting type portable apparatus having a case integrated type bangle type strap according to an embodiment of the invention.
Figure 2:
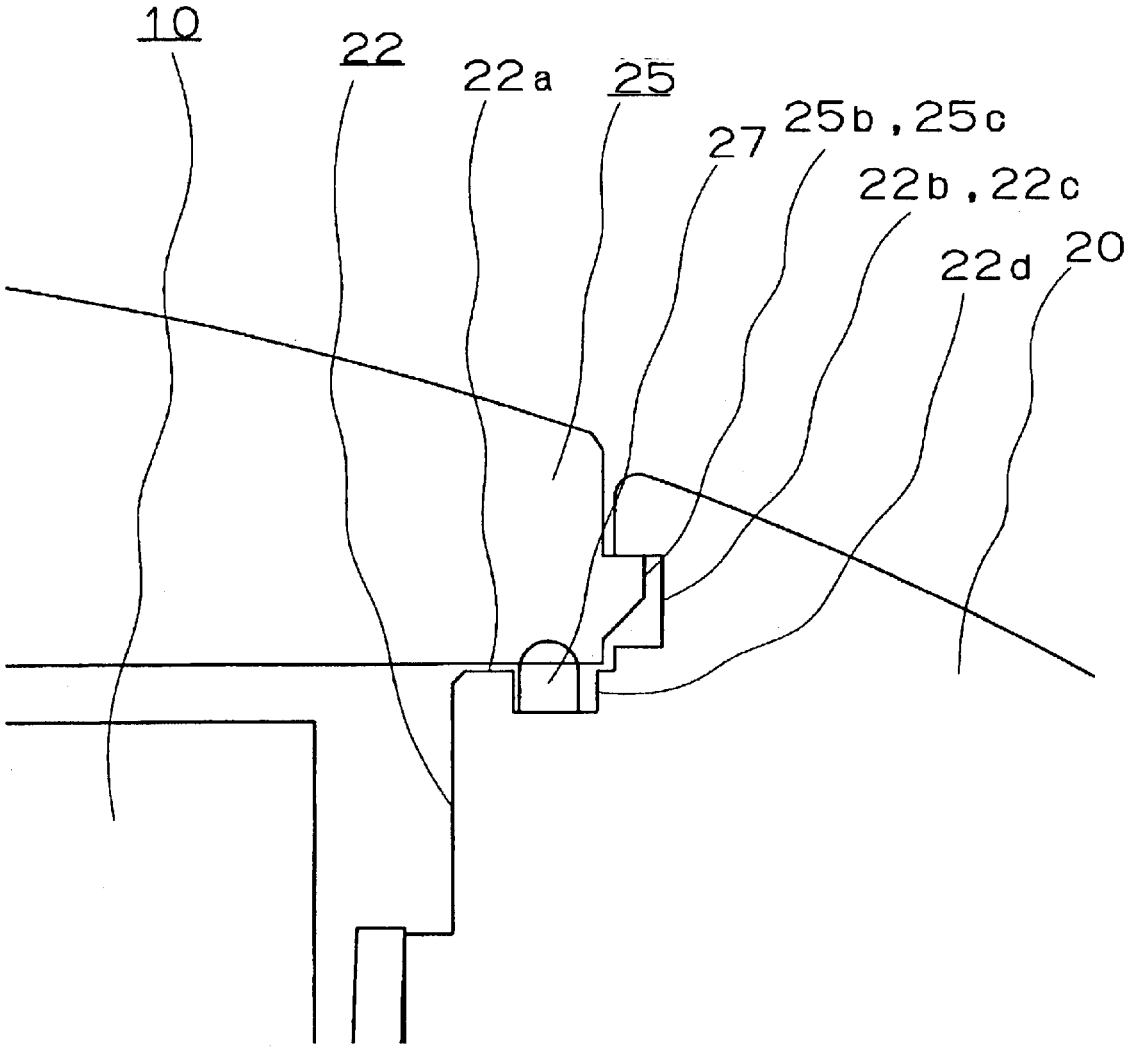
FIG. 2 is a partially enlarged sectional view of the sectional view of FIG. 1 cut in the strap length direction of the wrist mounting type portable apparatus having the case integrated type bangle type strap according to the embodiment of the invention.
Figure 3:
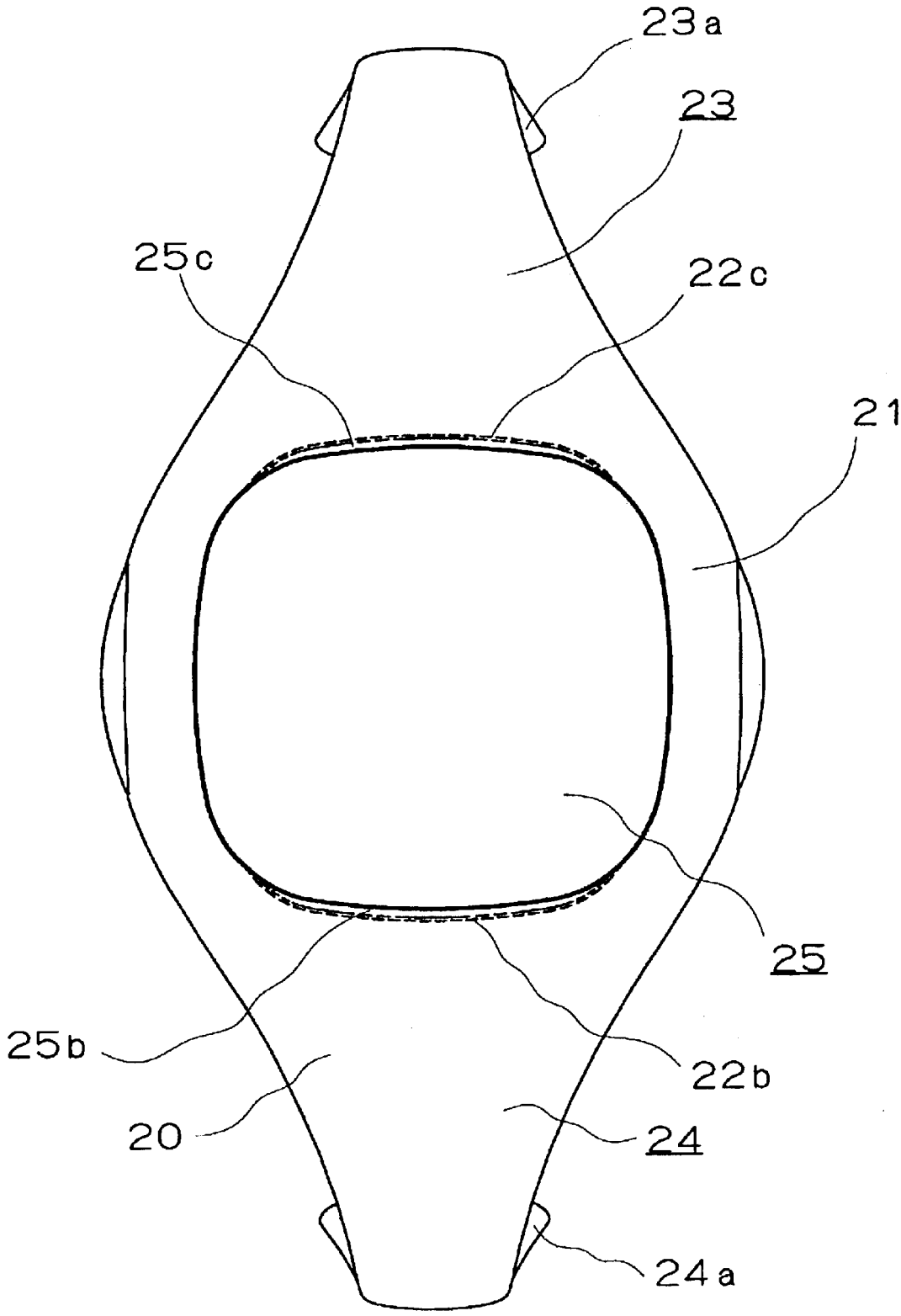
FIG. 3 is a plane view of the wrist mounting type portable apparatus having the case integrated type bangle type strap according to the embodiment of the invention.
Figure 4:
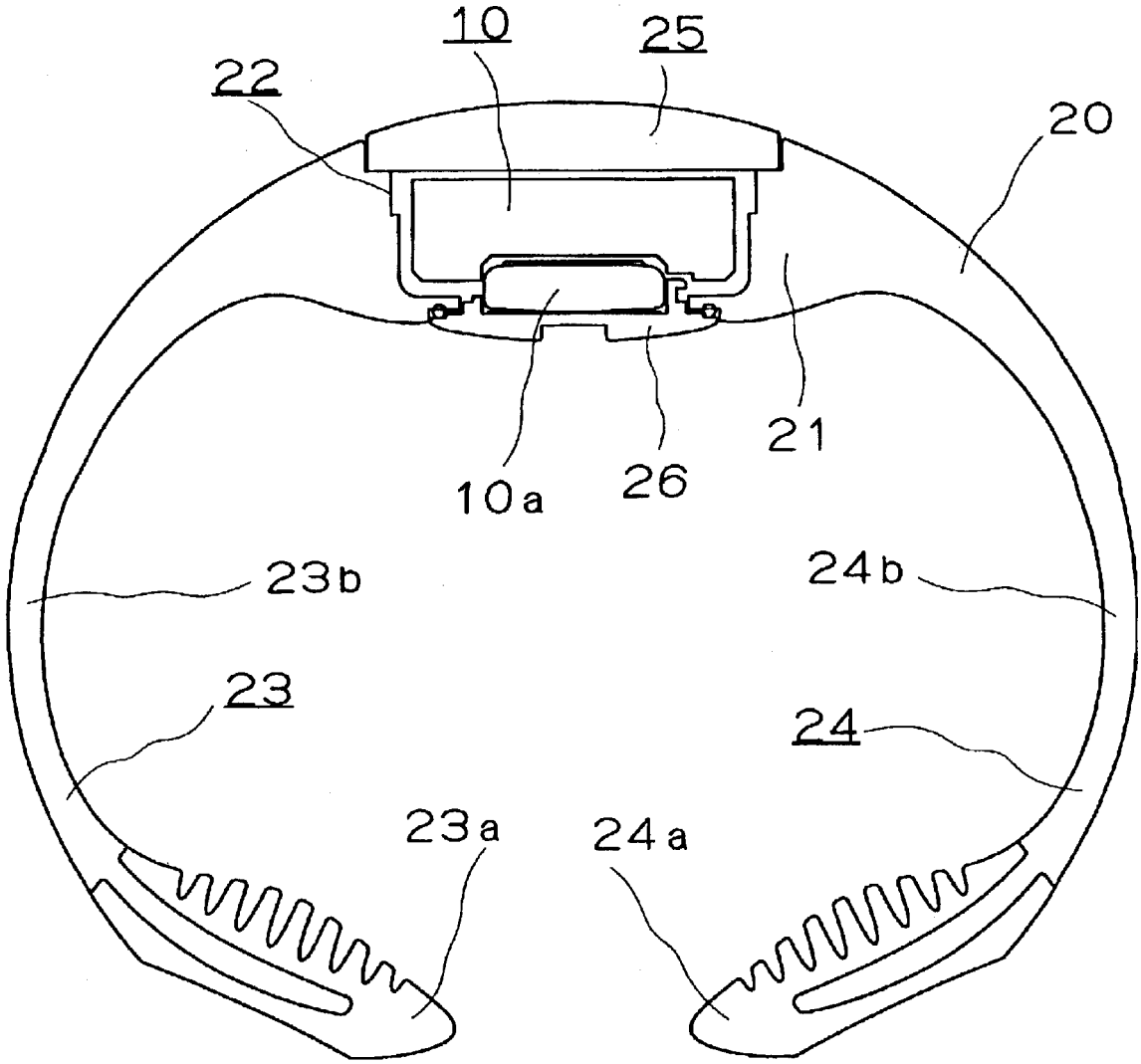
FIG. 4 PRIOR ART
FIG. 4 is a sectional view cut in a strap length direction of a wrist mounting type portable apparatus having a conventional case integrated type bangle type strap.

A wrist mounting type portable apparatus having a bangle type strap according to an embodiment of the invention will be explained in details as follows in reference to a sectional view of FIG. 1 cut in a strap length direction, a partially enlarged sectional view of FIG. 2 and a plane view of FIG. 3.

That is, the wrist mounting type portable apparatus having the case integrated type bangle type strap according to the embodiment of the invention is constituted by the portable apparatus 10 and the case integrated type bangle type strap 20. The case integrated type bangle type strap 20 is a strap made of plastic formed with the case hole 22 for containing the portable apparatus 10 at the central portion 21 having the thick wall and the wide width and integrally formed with the left side strap piece 23 and the right side strap piece 24 on the left and the right sides of the central portion 21. In the case of a portable type wrist watch, the portable apparatus is a time piece main body including a movement, a display portion and the like.

The case hole 22 is a hole having a size for containing the portable apparatus 10 and is a stepped through hole having an upper side opening having a large diameter and a lower side opening having a small diameter. Inside of the case hole 22 is arranged with a case hole reinforcing plate 28 along an inner peripheral face thereof. The case hole reinforcing plate 28 is fabricated by a material more rigid than the bangle type strap 20, for example, metal. The case hole reinforcing plate 28 restrains the case integrated type bangle type strap 20 from being deformed in a direction of the portable apparatus 10 when the case integrated type bangle type strap 20 is deformed and protects the portable apparatus 10.

The upper side opening of the case hole 22 is an opening having substantially a rounded square shape. A stepped portion 22*a* is formed at an inner peripheral face at a vicinity of the upper side opening of the case hole 22. The glass member 25 for closing the upper side opening of the case hole 22 is pushed to fit to the upper side opening and therefore, a longitudinal width and a transverse with thereof are basically the same as a longitudinal width and a transverse width of the upper side opening of the case hole 22.

The lower side opening of the case hole 22 is an opening in a circular shape. The lower side opening of the case hole 22 is closed by a structure similar to that of the conventional apparatus while maintaining the waterproof property. That is, the lower side opening of the case hole 22 is closed by a circular disk shape male screw 26 after containing the battery 10*a* at the predetermined location of the case hole 22. The rubber packing is arranged between the head portion of the circular disk shape male screw 26 and the peripheral edge portion of the lower side opening of the case hole 22 and the waterproof property of the lower side opening of the case hole 22 is maintained by screwing to fasten the circular disk shape male screw 26 to the female screw portion formed at the inner peripheral face of the lower side opening of the case hole 22.

The upper side opening of the case hole 22 is closed by the glass member 25 and the glass member and the case integrated type bangle type strap are fixed by a fixing structure according to the invention.

A structure of fixing the glass member to the case integrated type bangle type strap adopted in the embodiment of the invention is as follows. That is, the case integrated type bangle type strap 20 is a bangle type strap made of nylon species plastic. Further, the inner peripheral face of the case hole 22 of the case integrated type bangle type strap 20 is formed with fitting grooves 22*b* and 22*c*. Portions of forming the fitting grooves 22*b* and 22*c* are left and right inner peripheral faces of the case hole 22 in the strap length direction, or inner peripheral faces in correspondence with 12 o'clock and 6 o'clock positions of the timepiece. The portions are portions on which stresses in opening and closing the strap concentrate.

Meanwhile, fitting projections 25*b* and 25*c* are formed at a peripheral edge of the glass member 25. The fitting projections 25*b* and 25*c* are formed not at an entire peripheral edge of the peripheral edge of the glass member 25 but at peripheral edges in correspondence with the fitting grooves 22*b* and 22*c* formed at left and right inner peripheral faces of the case hole 22 in the strap length direction.

According to the invention, a structure of guaranteeing the waterproof property is adopted along with a structure of fixing the glass member and the case integrated type bangle type strap by the fitting grooves and the fitting projections. The structure of guaranteeing the waterproof property is constituted by a rubber packing 27 contained in a packing groove 22*d* formed at the stepped portion 22*a* of the inner peripheral face of the case hole 22.

According to the embodiment of the invention, the glass member 25 is fitted to the upper side opening of the case hole 22 after containing the portable apparatus 10 at the predetermined location of the case hole 22 and containing the rubber packing 27 to the packing groove 22*d*. Then, the lower face of the glass member 25 is seated on the stepped portion 22*a* of the case hole 22, the fitting projections 25*b* and 25*c* at the peripheral edge are fitted to respectively bite the fitting grooves 22*b* and 22*c* of the case hole 22 and thereby, the glass member 25 is fixed to the case integrated type bangle type strap 20. Further, the waterproof property of the upper side opening of the case 22 is guaranteed by the rubber packing 27.

Also when the wrist mounting type portable apparatus having the case integrated type bangle type strap according to the invention is mounted to the wrist, the end portion 23*a* of the left side strap piece 23 and the end portion 24*a* of the right side strap piece 24 are respectively pulled to the outer peripheral sides to open the strap. Then, the case hole 22 of the case integrated type bangle type strap 20 is applied with stresses produced by pulling to open the strap. The stresses applied by pulling to open the strap concentrate on the left and the right inner peripheral faces of the case hole 22 in the strap length direction and therefore, the case hole 22 is deformed.

However, the fixing structure by the fitting grooves and the fitting projections according to the invention is adopted at the portions concentrically applied with the stresses by opening and closing the strap and therefore, the peel off and the detachment of the glass member posing the problem in the fixing structure in the conventional apparatus by welding or adhering are not brought about. Even when the case hole 22 is deformed, the waterproof structure by the waterproof packing 27 is not influenced thereby. Therefore, even when the case hole 22 of the strap 20 is deformed by opening and closing the strap, the waterproof performance of the upper side opening of the case hole 22 is guaranteed. Further, even when the case hole 22 is deformed, the waterproof performance of the lower side opening of the case hole 22 is guaranteed similar to the conventional apparatus.

By the invention, even when the case hole is deformed by concentrating the stresses at the fixing portions of the glass member and the strap in opening and closing the case integrated type bangle type strap, the peel off of the fixed portion and detachment of the glass member from the case hole are not brought about. Further, even when the case hole is deformed, the waterproof structure by the waterproof packing arranged at the upper side stepped portion of the inner peripheral face of the case hole is not influenced thereby and therefore, the waterproof performance of the upper side opening of the case hole is guaranteed.

Further, the structure for fixing the glass member and the case integrated type bangle type strap according to the invention can be achieved without the requirement of a welding step or an adhering step using an adhering agent and, therefore, the fabrication cost can be reduced.

What is claimed is:

1. A wrist mounting-type portable electronic apparatus comprising:

a bangle-type strap member having a pair of strap portions each having an end disposed in spaced-apart relation to the other so that inner peripheral surfaces of the ends of the strap portions form a hole having a first open end and a second open end opposite the first open end, each of the inner peripheral surfaces of the strap portions having a stepped portion;

a portable electronic apparatus disposed in the hole of the bangle-type strap member;

a glass member supported on the stepped portion of each of the strap portions for closing the first open end of the hole of the bangle-type strap member;

connecting means free of adhesive for connecting the glass member to each of the strap portions;

a waterproof member disposed directly between only the glass member and the bangle-type strap member for providing a watertight seal therebetween; and a rear cover for closing the second open end of the hole of the bangle-type strap member.

2. A wrist mounting-type portable electronic apparatus according to claim 1; wherein the bangle-type strap member is made of nylon.

3. A wrist mounting-type portable electronic apparatus according to claim 1; wherein the connecting means comprises a groove formed in the inner peripheral surface of each of the strap portions and a pair of projections each extending from a peripheral edge of the glass member and disposed in a respective one of the grooves.

4. A wrist mounting-type portable electronic apparatus according to claim 3; wherein each of the projections of the glass member is spaced apart from the other and extends from a preselected portion of the peripheral edge of the glass member disposed opposite to and confronting a respective one of the grooves of the strap portions.

5. A wrist mounting-type portable electronic apparatus according to claim 3; wherein the projections of the glass member do not extend around the entire peripheral edge thereof.

6. A wrist mounting-type portable electronic apparatus according to claim 1; wherein the connecting means comprises a pair of grooves formed in a peripheral edge of the glass member and a pair of projections each extending from the inner peripheral surface of a respective one of the strap portions and disposed in a respective one of the grooves.

7. A wrist mounting-type portable electronic apparatus according to claim 1; wherein the connecting means is disposed at portions of the inner peripheral surfaces of the strap portions extending in a longitudinal direction of the bangle-type strap member.

8. A wrist mounting-type portable electronic apparatus according to claim 1; wherein the glass member has an upper surface exposed to an exterior of the wrist mounting-type electronic portable apparatus and a lower surface; and wherein the waterproof member is disposed between the lower surface of the glass member and the stepped portion of each of the strap portions of the bangle-type strap member.

9. A wrist mounting-type portable electronic apparatus according to claim 8; wherein the waterproof member is disposed in direct contact with the lower surface of the glass member and a seat of each of the stepped portions.

10. A wrist mounting-type portable electronic apparatus according to claim 1; further comprising a reinforcing member disposed between the portable electronic apparatus and the inner peripheral surfaces of the strap portions for reinforcing the strap portions to prevent deformation of the strap portions in directions towards the portable electronic apparatus during movement of the bangle-type strap member relative to the portable electronic apparatus.

11. A wrist mounting-type portable electronic apparatus according to claim 10; wherein the reinforcing member is made of a material which is more rigid than a material of the bangle-type strap member.

12. A wrist mounting-type portable electronic apparatus according to claim 1; wherein the waterproof member comprises a first waterproof member; and further comprising a second waterproof member disposed between the rear cover and each of the strap portions of the bangle-type strap member for providing a watertight seal therebetween.

13. A wrist mountable portable electronic apparatus comprising:

a pair of strap portions each having an inner peripheral surface disposed in opposite and spaced-apart relation to the other to form a hole having a first open end and a second open end opposite the first open end;

a portable electronic apparatus disposed in the hole formed by the strap portions;

a glass member connected to each of the strap portions and covering the first open end of the hole;

a rear cover covering the second open end of the hole; and a waterproof seal member disposed between the glass member and each of the strap portions for providing a watertight seal therebetween such that the waterproof seal member does not contact the rear cover.

14. A wrist mountable portable electronic apparatus according to claim 13; further comprising a groove formed in the inner peripheral surface of each of the strap portions and a pair of projections each extending from a peripheral edge of the glass member and disposed in a respective one of the grooves.

15. A wrist mountable portable electronic apparatus according to claim 14; wherein the projections of the glass member do not extend around the entire peripheral edge thereof.

16. A wrist mountable portable electronic apparatus according to claim 13; further comprising a pair of grooves formed in a peripheral edge of the glass member and a pair of projections each extending from the inner peripheral surface of a respective one of the strap portions and disposed in a respective one of the grooves.

17. A wrist mountable portable electronic apparatus according to claim 13; wherein the glass member has an upper surface exposed to an exterior of the electronic portable apparatus and a lower surface; and wherein the waterproof seal member is disposed in a recess formed in the inner peripheral surface of each of the strap portions and in direct contact with the lower surface of the glass member.

18. A wrist mountable portable electronic apparatus according to claim 13; further comprising a reinforcing member disposed between the portable electronic apparatus and the inner peripheral surfaces of the strap portions for reinforcing the strap portions to prevent deformation of the strap portions in directions towards the portable electronic apparatus during movement of the strap portions relative to the portable electronic apparatus.

19. A wrist mountable portable electronic apparatus according to claim 18; wherein the reinforcing member is made of a material which is more rigid than a material of the bangle-type strap member.

20. A wrist mountable portable electronic apparatus according to claim 13; wherein the waterproof member comprises a first waterproof member; and further comprising a second waterproof member disposed between the rear cover and each of the strap portions for providing a watertight seal therebetween.

* * * * *